United States Patent [19]

Miner

[11] 4,354,379

[45] Oct. 19, 1982

[54] METHODS AND APPARATUS FOR TESTING ROUNDNESS AND STRAIGHTNESS OF PIPES AND TUBINGS

[76] Inventor: Robert M. Miner, 1855 Glendale, Casper, Wyo. 82601

[21] Appl. No.: 181,948

[22] Filed: Aug. 27, 1980

[51] Int. Cl.[3] ..... G01B 5/12

[52] U.S. Cl. ..... 73/37; 33/DIG. 2; 73/432 R

[58] Field of Search ..... 73/37, 37.5, 37.9, 432 R; 33/178 F, DIG. 2

[56] References Cited

U.S. PATENT DOCUMENTS

| | | | |
|---|---|---|---|
| 2,686,039 | 8/1954 | Bender . | |
| 2,953,919 | 9/1960 | Potts | 73/49.5 |
| 3,024,651 | 3/1962 | McGlasson . | |
| 3,518,873 | 7/1970 | Iglehart et al. | 73/49.5 |
| 3,755,908 | 9/1973 | Ver Nooy | 33/178 F |
| 3,973,441 | 8/1976 | Porter | 73/432 R |
| 4,000,655 | 1/1977 | Jones | 73/432 R |
| 4,091,678 | 5/1978 | Potter | 73/432 R |
| 4,098,126 | 7/1978 | Howard | 73/432 R |
| 4,170,902 | 10/1979 | Pallan | 73/432 R |

FOREIGN PATENT DOCUMENTS

| | | | |
|---|---|---|---|
| 1060394 | 4/1954 | France | 73/37 |

*Primary Examiner*—Anthony V. Ciarlante
*Assistant Examiner*—Joseph W. Roskos
*Attorney, Agent, or Firm*—Laurence R. Brown

[57] ABSTRACT

A carefully dimensional drift is passed through a pipe section by fluid pressure to assure that the pipe is round and straight and of the right dimensions. The drift is light weight with an elastic contact surface, preferably of 70-D durometer hardness urethane, and thus is easily handled, adaptable to the fluid transit through the pipe and offers very long wear.

17 Claims, 6 Drawing Figures

FIG. 3
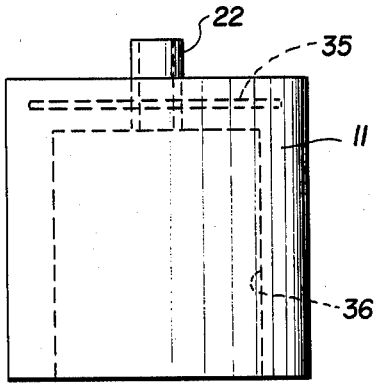
FIG. 4
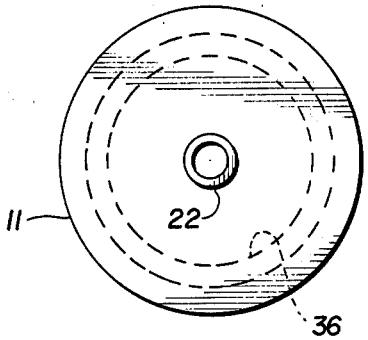
FIG. 5
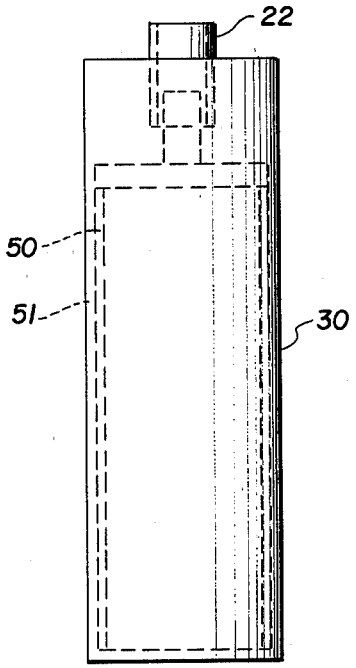
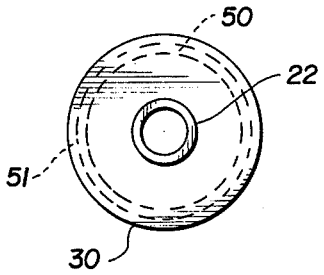
FIG. 6

METHODS AND APPARATUS FOR TESTING ROUNDNESS AND STRAIGHTNESS OF PIPES AND TUBINGS

TECHNICAL FIELD

This invention relates to testing of pipes, casings and tubings for roundness and straightness and more particularly it relates to such testing by passing such a closely toleranced pig or drift through the pipes or tubes that it will go through only when the tolerances are proper.

BACKGROUND ART

Typically in the prior art cylindrical steel pigs or drifts sized closely in diameter to the tolerance of the inside pipe diameter were drawn through a pipe, casing or tubing (hereinafter generally referred to as pipe) by a tape to determine that the pipe was of the desired inside diameter and straightness for testing pipe sections before use in such critical applications as for oil wells, etc. Typical time to rig and test a twenty to thirty foot (about 7 to 10 meters) pipe section for example would be about two minutes.

One significant problem of the prior art is the high cost of testing because of the long time taken to rig and test a pipe section. Also, the wear of the drift and the tediousness of backing out a drift stuck in a defective pipe added significant cost. Furthermore, to test various size pipe drifts of various sizes are necessary and the weight and cost of the steel drifts provide further problems. Other problems are set forth for example in the U.S. Pat. No. 2,953,919 to E. L. Potts of Sept. 27, 1960.

Yet this simple testing technique of using the drift dimensions as a test standard is preferred over the delicate instrumentation inside the drift as for example used in U.S. Pat. No. 3,024,651 R. L. McGlasson, Mar. 13, 1962 and U.S. Pat. No. 4,170,902 W. Pallan, Oct. 16, 1979, or the introduction of fluid under pressure into the pipe as in U.S. Pat. No. 3,518,873 to J. H. Iglehart et al., July 7, 1970.

Therefore it is an object of this invention to provide improved pipe testing methods and means reducing the cost and time of pipe testing and overcoming problems of the prior art including those aforesaid.

DISCLOSURE OF THE INVENTION

Pipe sections are tested by passing a cylindrical drift member therethrough in a preferred embodiment by means of fluid pressure (or vacuum), preferably pneumatic, rather than by pulling it through by a cable or tape.

The invention provides a light-weight long-wear drift with a pipe inner surface contact region of elastic material preferably urethane rubber of 70-D durometer hardness. This drift is closely dimensioned within about 0.020 inch (0.05 cm) of the specified tolerance of the inner pipe circumference, for example. Because of light weight it is readily transported in several pipe sizes and can be passed through a twenty to thirty foot (7 to 10 meter) pipe section of four to six inch (10 cm to 15 cm) diameter rapidly in about four seconds with a pump capable of 120 cubic feet per minute capacity. Also because of the elasticity, the wear is very long as compared with steel drifts, or the like. Wear is a critical item because the test method is dependent upon the dimensions of the cylindrical drift member.

Other features, advantages and embodiments will be found throughout the following description, claims and drawing.

BRIEF DESCRIPTION OF THE DRAWINGS

In the drawing:

FIGS. 3 and 4 are respectively side view and end view of a first drift embodiment; and FIGS. 5 and 6 are respectively side view and end view of a second drift embodiment.

DETAILED DESCRIPTION OF PREFERRED EMBODIMENTS

Figure 1:
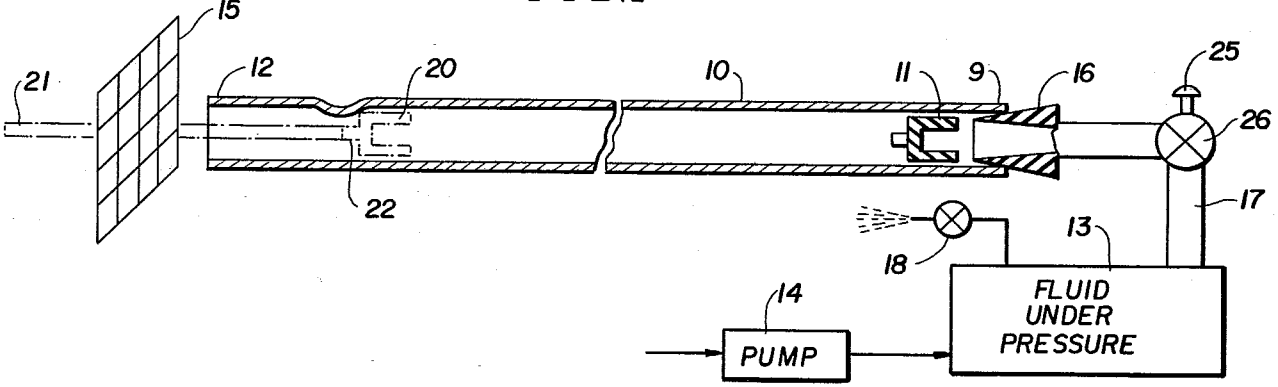
FIGS. 1 and 2 are respectively schematic system diagrams of a pipe section testing system operating in a pressure and vacuum mode.

As may be seen from FIG. 1, a pipe section 10 has a drift 11 put into the pipe at one end 9 and blown to the other end 12 by means of a pressure source indicated at tank 13 as supplied by pump 14. The drift 11 is sectioned as a resilient body of urethane rubber or the like to produce a light enough, friction free surface for passing through a 15 to 25 meter pipelength by means of a reasonable pressure or fluid flow from tank 13 such as 120 cubic feet per minute for a four to six inch diameter (10 to 15 cm) pipe. The fluid is preferably air. A net 15 may be used to catch the drift 11 as it emerges from the opposite end 12 if desired.

In one mode of operation, the drift 11 may be manually entered into pipe end 9 and then a resilient cone shaped member 16 entered to close the pipe end and connect the fluid flow conduit 17 from the pressure tank 13, which pump 14 and relief valve 18 maintains at adequate pressure to provide fluid at the aforesaid flow rate for sending drift 11 in transit through pipe section 10 in about four seconds. Of course, the pressures, flow rates, etc. vary for different pipe sizes, tolerances, pump and tank capacities and field conditions, but are easily determined in use by readily available controls over fluid flow rate and pressures.

The drift 11 because of its elastic surface or urethane, or the like, will pass as a missile through the tube with little wear and will adapt to pipe irregularities without damage or wear. Also it will keep its closely maintained tolerances to give consistent performance in eliminating out of tolerance pipe variations. Typically the drift 10 for a 6 inch diameter (15.24 cm) pipe has an equal axial length. This is preferable for large diameter pipes, since they are not easily bent out of straightness tolerance as are smaller diameter pipes where a longer axial dimension is preferred as hereinafter discussed.

Dependent upon fluid flow, pressure, length of impulse time, etc., the drift is given enough transit impact to carry it through the pipe length if the tolerance is proper. If the circumference is too large by out of roundness, etc., the fluid may by-pass the drift and thus if limited in time, cannot pass the drift 11 entirely through the pipe section. Similarly if burrs or out of roundness make the pipe diameter too small, then the drift 11 will stick in the pipe as shown by phantom view 20. A lodged drift 11 can be retrieved by means of rod or pipe 21 screwed into coupling 22 so that it can be pushed or pulled to a respective end of the pipe.

Since a large amount of pressure or a long time of pressure flow might tend to deform the elastic outer contact surface of the drift and thus pass it through an out of tolerance position, either the pressure is limited as by relief valve 18, or the time of application of the fluid flow is limited such as manual timing by button 25 for opening valve 26. Thus, if, for example, the expected transit time of the drift is four seconds, a four second blast of fluid flow can result from holding down button 25 for four seconds. Likewise the pressure in tank 13 can be kept just enough to pass the drift 11 through an in-tolerance pipe section but not enough to dislodge a drift stuck in the pipe section because of a decreased diameter defect. In the case of pump casings where both larger and smaller diameters are critical, the timed flow method will indicate also when too much fluid leaks about the drift in a larger diameter defect part of the pipe so that it doesn't reach the opposite end with the allocated flow impulse or within the specified time otherwise measured.

Additionally a bypass hole of one inch diameter in a six inch diameter may be used inside the drift coupling 22 to prevent the tendering for pressure to dislodge the drift.

Figure 2:
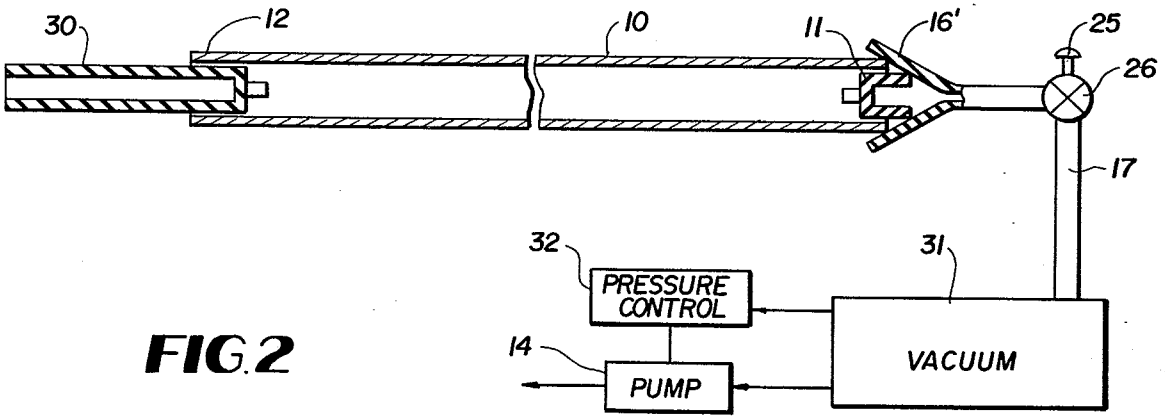

In the embodiment of FIG. 2, a longer drift 30 is used and a vacuum tank 31 along with the valve 25-26, pump 14 and a pressure control device 32. In this case the drift 30 is manually inserted at the far end 12 of pipe 10 and is sucked to the near end 9 when valve 26 is opened by button 25, for testing in the manner aforesaid.

If the pipe is smaller diameter it may have become bent and thus straightness tolerances are important. By use of a longer drift 30, the passage around a pipe bend is more difficult and thus by choosing the length of the drift, a desired straightness tolerance can be identified.

The vacuum technique is preferred since the drift is always received at the soft urethane plug 16' which cushions its impact and makes it ready for retrieval without exiting the pipe 10.

A typical short cup shaped hollow light drift 11 construction is shown in FIGS. 3 and 4. Thus the drift body is substantially all 70-D durometer hardness urethane, except for an anchor plate 35 of aluminum about the threaded coupler 22 embedded in the head end of the cup presenting the hollowed out trailing section 36. This is light and particularly adapted for the fluid flow test method aforesaid, but could also by means of adapting coupler 22 be pulled through a pipe section by cable or tape with the advantage of light weight and long wear. Typical dimensions for a six inch diameter pipe are diameter six inches less 0.020 inch and length six inches.

However, as shown in FIGS. 5 and 6 the length to diameter ratio is much larger. A typical length of forty-two inches for a three inch diameter pipe then provides a test medium for a high degree of pipe straightness. To keep the drift 30 herein shown light weight it has an internal aluminum skeleton 50 with an outer coating 31 of the urethane of 70-D durometer hardness. It is used in the manner aforesaid and with the same advantages. The internal metal may be wire, fabric or expanded metal to further decrease weight while keeping the necessary rigidity to test pipe straightness.

INDUSTRIAL APPLICATION

To quickly test pipe such as oil well casings and pipe sections before installation in a string, a close tolerance drift is passed through a thirty foot (ten-meter) pipe section of four to six inches (10 to 15 cm) in diameter in about four seconds by a source of fluid under pressure or vacuum capable of about 120 cubic feet per minute such as an air pressure system. This is faster and easier to set up than by pulling a drift by cable or tape and has much longer life and wear because of special urethane rubber contact surface of the drift.

I claim:

1. The method of testing pipe sections for roundness, straightness and internal surface defects, comprising the steps of:

inserting into one end of a section of pipe a light weight cylindrical drift member of a circumference within close tolerance to the internal pipe circumference specification and having a substantially friction free outer surface structure for contacting the inner pipe wall, and impacting said cylindrical member with sufficient fluid flow directed into one end of the section of pipe to move the cylindrical member through the section of pipe from one end to pass out the other end thereby to indicate whether the pipe is within specification tolerance without burrs, indentations, out-of-round or straightness conditions tending to impede the transit of the member along the pipe length.

2. The method of testing pipe sections as defined in claim 1 including the step of limiting the time of impact of the fluid to substantially that necessary to just drive the cylindrical member through the length of a pipe section within tolerance.

3. The method of testing pipe sections as defined in claim 1 including the step of coupling a cone shaped resilient member to one end of the pipe for passing said fluid thereinto for moving the drift member to drive the cylindrical member through the length of a pipe section within tolerance.

4. The method of testing pipe sections as defined in claim 1 including the step of preparing an outer surface on the cylindrical member of an elastic substance which conforms with internal pipe surface changes within a specified tolerance range, and which is self lubricating for long wear.

5. The method of testing pipe sections as defined in claim 4 wherein the elastic substance is urethane rubber of a hardness of the order of 70-D durometer.

6. The method of testing pipe sections as defined in claim 1 wherein the cylindrical member is provided with an axial pipe coupling member, including the steps of removing the coupling member when lodged in a position along the pipe length because of an out of tolerance condition by engaging the coupling member with a rod or pipe and moving it through the pipe to exit at one end.

7. The method of claim 1 wherein the fluid flow is derived from a vacuum source to pull the drift member through the pipe.

8. The method of claim 1 wherein the fluid flow is derived from an air pressure souce to push the drift member through the pipe.

9. A system for testing sections of pipe for roundness and straightness, comprising in combination, at least one light weight cylindrical member of close dimensions to the internal diameter of the pipe specifications constructed of a resilient low friction material at least over the entire outer surface portion adapted to engage the inner surface of the pipe, a source of fluid flow, means coupling the source of fluid flow to one end of a pipe section to impact the cylindrical member inside the pipe sections to pass it through only those pipe sections within specified tolerances of roundness and straightness and means for limiting the fluid flow impacting the cylindrical member to an amount just sufficient to pass the cylindrical member along the length of a pipe section and out the other end when the pipe is within specified tolerances.

10. The cylindrical member of claim 9 where the surface material is urethane rubber.

11. The cylindrical member of claim 10 where the urethane rubber has a hardness in the order of 70-D durometer.

12. The cylindrical member of claim 9 wherein substantially the entire cylindrical member is of said material.

13. The cylindrical member of claims 9 or 12 wherein an axial coupler is integrally affixed to the member for receiving a rod or pipe into mating engagement therewith.

14. The cylindrical member of claim 9 wherein the cylindrical member comprises an aluminum body with an outer surface coating of said material.

15. The cylindrical member of claim 9 having an axial length of substantially its diameter.

16. The cylindrical member of claim 9 having an axial length substantially longer than its diameter.

17. The cylindrical member defined in claim 9 having light weight and shaped as a hollow cylinder closed at a leading end, thereby to be passed through the section by fluid pressure.

* * * * *